United States Patent [19]

Brubaker

[11] Patent Number: 4,813,884

[45] Date of Patent: Mar. 21, 1989

[54] HIGH CONTACT PRESSURE INSULATION DISPLACEMENT TERMINAL FOR MULTI-STRAND WIRE

[75] Inventor: Weldon Brubaker, San Clemente, Calif.

[73] Assignee: Molex Incorporated, Lisle, Ill.

[21] Appl. No.: 131,870

[22] Filed: Dec. 11, 1987

[51] Int. Cl.[4] ..... H01R 9/00

[52] U.S. Cl. ..... 439/389; 439/395

[58] Field of Search ..... 439/389, 391, 395, 396, 439/408, 417, 418, 421

[56] References Cited

U.S. PATENT DOCUMENTS

| | | | |
|---|---|---|---|
| 1,847,122 | 3/1932 | MacIntyre | 439/389 |
| 2,462,247 | 2/1949 | Wright | 439/776 |
| 3,566,006 | 2/1971 | Metcalf | 439/389 |
| 3,579,178 | 5/1971 | Travis | 439/389 |
| 3,997,236 | 12/1976 | Bresin | 439/389 |
| 4,637,675 | 1/1987 | Loose | 439/391 |

*Primary Examiner*—William L. Sikes
*Assistant Examiner*—Frank González
*Attorney, Agent, or Firm*—John W. Cornell; Louis A. Hecht

[57] ABSTRACT

An insulation displacement terminal is provided to achieved high pressure against the conductors of a multi-strand wire and to minimize the amount of strand rearrangement likely to occur with fine strand wires. The terminal comprises at least one insulation displacement contact comprising a pair of spaced apart generally parallel cantilevered contact arms defining a slot therebetween. The slot includes a conductor engaging portion having a length and width sufficient to receive the bundle of conductor strands in the wire. The conductor engaging portion terminates at a pair of inwardly directed convex non-cutting bulges which in the unstressed condition of the terminal are in very close proximity to one another. The bulges define a lower limit of movement of the conductive strands into the slot allowing the insertion force to increase. The camming surfaces defined by the bulges act as ramps to convert the increased insertion forces of the wire into lateral forces on the cantilevered contact arms. These outward forces provide the deflection needed to develop and maintain reliable resilient contact forces in the terminal arms which will be urged laterally into the wire strands and substantially reduce strand rearrangement. The insulation piercing barbs may further be bent over the conductive strands to more positively retain the wire in the terminal.

15 Claims, 3 Drawing Sheets

HIGH CONTACT PRESSURE INSULATION DISPLACEMENT TERMINAL FOR MULTI-STRAND WIRE

BACKGROUND OF THE INVENTION

Insulation displacement terminals typically comprise at least one insulation displacement contact portion including a slot into which an insulated wire is urged in a direction transverse to the axis of the wire. The slot of the insulation displacement contact includes a portion which is dimensioned and configured to slice through the insulation of the wire as the wire is moving transversely into the slot. The slicing and displacement of the insulation permits edges of the slot below the slicing portion to make electrical contact with the conductors of the wire. Thus, insulation displacement terminals avoid the initial stripping of insulation from the conductor and can avoid the subsequent soldering or crimping of the conductor to the terminal.

The effectiveness of the insulation displacement terminal depends, in part, on the ability of the cantilevered arms of the contact portions to maintain good contact pressure against the conductor. This can be accomplished relatively easily with single strand conductors by merely dimensioning the slot between the cantilevered arms to be a selected distance less than the cross-sectional diameter of the single strand conductor. Thus, upon insertion of the wire into the insulation displacement contact portion, the cantilevered arms of the contact portion will be outwardly deflected by the conductor. The metallic terminal is resilient and designed to respond to the outward deflection elastically. Consequently, outward deflection of the cantilevered arms upon insertion of the wire generates inwardly directed resilient contact forces exerted by the terminal against the conductors for a gripping electrically conductive engagement. These same design theories apply to some wires having multi-strand conductors, and particularly wires having fewer than about twenty strands that have been tightly twisted before the covering insulation is applied.

Recently, electronic and electrical equipment such as household appliances, telecommunications equipment, computers and the like have specified wires employing multi-strand conductors employing a substantially larger number of strands for a given cross-sectional area of the conductor, with the individual strands being of a proportionally smaller cross-sectional dimension. For example, specifications for some high current equipment require wire with a 40 strand conductor defining a total cross-sectional area of 1.25 square mm. Thus, each strand may define a diameter of approximately 0.2 mm. or 0.008 inch. Still other applications envision the use of 100 strand wire where individual strands will approach the thickness of a human hair.

It has been found that the prior art insulation displacement terminals are less effective when used with the above described multi-strand wires having a larger number of strands and with each strand being finer. In particular, it has been found that the strands tend to rearrange substantially upon insertion of the wire into the slot of the insulation displacement terminal presumably at least partly because of the larger number of interstices. This rearrangement of the strands will occur without causing a desired level of outward deflection or the development of the desirable inwardly directed resilient contact forces on the conductors by the cantilevered arms of the prior art insulation displacement terminal. This substantial decrease in deflection and therefore the resilient contact forces or the pressure of the cantilevered arms against the rearranged conductors can result in a significantly poorer quality electrical connection. The ability to develop acceptably high resilient contact forces becomes even more difficult when space limitations effectively reduce the length of the cantilevered arms, thereby reducing the cantilevered moment arm.

The prior art has considered the problem of rearrangement of conductor strands in the context of wires having a comparatively small number of strands. Although many of these prior art structures have been effective for achieving adequate contact pressure for a comparatively small number of strands, they become less effective as the number of strands in the multi-strand wire increases. For example, U.S. Pat. No. 4,317,608 which issued to Dechelette on Mar. 2, 1982 shows an insulation displacement terminal which attempts to address the problem of the rearrangement of strands relative to one another as the wire is urged into the connector. In particular, U.S. Pat. No. 4,317,608 shows an insulation displacement terminal used with wires having between 12 and 18 strands and having a total cross-sectional area of between 0.6–2.0 square millimeters. The slot of the terminal shown in U.S. Pat. No. 4,317,608 includes a pair of opposed convex converging cutting edges which lead to a narrow cutting throat and which then diverge outwardly. These outwardly diverging cutting edges adjacent to the narrow throat terminate at an opposed pair of convex converging noncutting sides which in turn terminate at a generally circular aperture defining the base of the slot. The terminal of U.S. Pat. No. 4,317,608 is designed for the strands of the wire to be disposed generally in the proximity of the narrow throat defined by the converging cutting edges. In particular, the core defined by the strands of the conductor are rearranged longitudinally with respect to the axis of the slot such that a first portion of the strands are disposed between the converging cutting edges and such that a second portion of the strands are disposed adjacent the diverging cutting edges of the terminal. The contact pressure against the strands is provided by the converging cutting edges.

The terminal shown in U.S. Pat. No. 4,317,608 is not sufficiently effective to prevent the rearrangement of the very fine strands described above and thus would not provide sufficient contact pressure against the conductor required in high current applications. Furthermore, the contact pressure exerted by the converging cutting edges could damage the very fine conductor strands now being used.

Another somewhat relevant insulation displacement terminal is shown in U.S. Pat. No. 4,002,391 which issued to Dunn et al on Jan. 11, 1977. The terminal of U.S. Pat. No. 4,002,391 includes a pair of cantilevered arms defining a slot therebetween. The slot includes a narrow wire engaging top portion and an enlarged base portion. One of the cantilevered arms of the terminal is provided with a pair of swages axially spaced from one another along the length of the narrow top portion of the slot. The swages are intended to prevent the single strand wire mounted in the terminal from vibrating out of the slot or into the enlarged base portion of the slot. The two swages on the one arm of the terminal do not affect the degree of contact pressure exerted on the conductor. A similar terminal with a swage for controlling the degree of insertion is shown in U.S. Pat. No. 4,682,835.

The prior art also includes several insulation displacement terminals which rely substantially upon the crimping over of contact arms to achieve the required contact pressure. Examples of such terminals are shown in U.S. Pat. No. 4,159,156 and in U.S. Pat. No. 4,288,918.

An effective prior art insulation displacement terminal is shown in U.S. Pat. No. 4,527,852 which issued to Dechelette on July 9, 1985 and which is assigned to the assignee of the subject invention. The terminal of U.S. Pat. No. 4,527,852 includes a guide portion for guiding the wire including the insulation into a pair of opposed insulation piercing barbs which lead into a narrower cutting portion of the slot. The narrow cutting portion includes protrusions on each side of the slot extending outwardly from the plane of the metal material from which the terminal is made. The protrusions effectively urge the insulation away from the slot to further enhance the quality of the electrical connection. Although the terminal shown in U.S. Pat. No. 4,527,852 has many structural and functional advantages, it is desired to provide a terminal that more positively prevents rearrangement of the strands in a wire having a large number of very fine strands, and to further increase the resilient contact forces exerted upon the conductors by the cantilevered arms of the terminal.

Accordingly, it is an object of the subject invention to provide an insulation displacement terminal effective for use with wires having a large number of fine strands.

It is another object of the subject invention to provide an insulation displacement terminal which provides enhanced contact pressure against the conductors by the cantilevered arms of the terminal.

It is a further object of the subject invention to provide an insulation displacement terminal which relies upon stored energy of deflected contact arms upon the conductors of the wire.

An additional object of the subject invention is to provide an insulation displacement terminal which provides sufficient pressure against the fine conductive strands of a wire to deform the strands and prevent excessive rearrangement of the strands relative to the terminal.

It is another object of the invention to provide an insulation displacement terminal including a contact slot configuration which is effective to restrict downward travel of the wire strands within the slot during insertion to cause a build up in the insertion forces exerted by the wire on the terminal to provide improved deflection of the cantilevered arms and increased resilient contact forces between the arms and the wire strands.

Still another object of the subject invention is to provide an insulation displacement terminal which relies upon stored energy of the contact arms and which enables the contact arms to be crimped over the wire to retain the strands in position.

SUMMARY OF THE INVENTION

The subject invention is directed to an insulation displacement terminal which includes a pair of spaced apart arms extending from and unitary with a base to define a slot therebetween. The arms may comprise opposed side edges distal from the base and spaced apart a distance equal to or slightly less than the width of the wire with the insulation thereon to define an entry channel.

The entry channel of the slot terminates at a pair of insulation piercing barbs which extend toward the opened end of the channel. The insulation piercing barbs are disposed respectively on the arms of the terminal but are spaced inwardly from the side walls of the entry channel. The distance between each insulation piercing barb and the corresponding side wall of the entry channel is equal to or less than the radial thickness of the insulation on the wire. The insulation piercing barbs may be separated from the corresponding arms of the terminal by longitudinally extending slots. The slots will permit the insulation piercing barbs to be folded over a wire trapped in the terminal, as explained further below, to ensure positive retention and to enhance the contact pressure against the conductive strands of the wire.

The slot of the subject insulation displacement terminal includes a non-cutting strand retention zone between the respective barbs. The width of the strand retention zone is less than the width of the core of conductive strands within the wire. Thus, the insertion of the strands into the strand retention zone will require a combination of outward flexing of the terminal arms and rearrangement of the strands. The length of the strand retention zone is selected in view of its width to achieve a strand retention area equal to or greater than the total cross-sectional area of the strands to ensure that all of the strands will fit within the strand retention zone.

The strand retention zone terminates at a pair of non-cutting convex bulges extending into the slot to define a constriction therein. The bulges may be in abutting contact or may be slightly spaced from one another. The bulges may be formed by a coining or stamping operation which urges the metallic material of the terminal arms into the slot. The bulges preferably are defined by gradually converging edges of the slot.

The slot extends an axial distance beyond the two bulges in the arms. This distance is as great as possible within the physical limitations provided for the terminal to maximize the length of the bending moment for each arm, and preferably extends a distance beyond the bulges greater than the width of the slot.

In operation, the wire is inserted into the entry channel and is guided toward the insulation piercing barbs by the parallel side walls of the entry channel. The insulation piercing barbs will cut through and displace the insulation surrounding the conductive strands. However, the relative dimensions ensure that all of the strands will be disposed intermediate the two insulation piercing barbs. Continued movement of the wire into the slot will cause a rearrangement of the strands and an outward flexing of the terminal arms. A sufficient insertion of the wire into the terminal will urge the strands into contact with the inwardly directed non-cutting generally convex bulges in the slot. The bulges effectively form a restriction in the slot to prevent further downward movement of the wire strands to increase the insertion forces exerted by the inserted wire against the cantilevered arms. The bulges also define cams for the wire to push against at a location a substantial distance away from the bottom of the slot. The tapered converging configuration of the bulges effectively converts the higher insertion forces of the strands on the bulges into lateral forces which displace or deflect the cantilevered arms outwardly and which then utilize the stored energy for urging the terminal arms inwardly and against the strands. The high insertion forces of the wire against the bulges and the correspondingly created inward resilient contact forces of the terminal arms will create sufficient forces on the wire to deform the strands therein and create flats on the strands. The above described maximum distance of the bulges from the bottom of the slot increases the deflection of the arms and therefore the resilient inwardly directed response of the cantilevered terminal arms and maximizes the inwardly directed contact forces on the wire. The downward movement of the wire is of a magnitude to prevent the strands from moving significantly beyond the bulges.

After the wire has been properly seated in the insulation displacement terminal, the insulation piercing barbs may be rotated away from their respective terminal arms and bent over the top of the wire strands to: positively retain the wire therein; prevent the wire strands from rising in the slot; increase the contact area; and further enhance and maintain the resilient contact forces on the strands.

The bulges of the cantilevered arms enable acceptably high lateral resilient contact forces to be developed even in environments which limit the length of the arms. Thus, the subject terminal can be employed in physically restricted environments which heretofore effectively precluded insulation displacement terminals.

DETAILED DESCRIPTION OF THE PREFERRED EMBODIMENT

Figure 1:
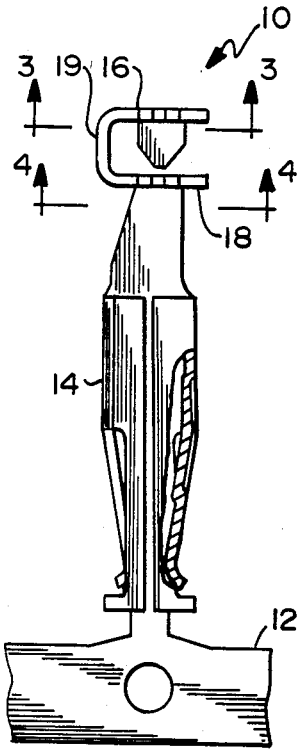
FIG. 1 is a cross-sectional view of an in-line insulation displacement terminal according to the subject invention.
Figure 2:
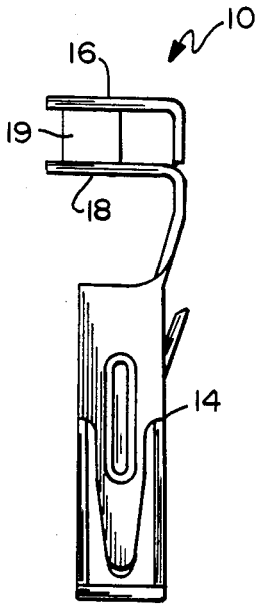
FIG. 2 is a side elevational view of the terminal shown in FIG. 1.

The insulation displacement terminal of the subject invention is indicated generally by the numeral 10 in FIGS. 1–4. The terminal 10 is formed by stamping a sheet or strip of metal in a progressive die apparatus to define a plurality of terminals 10 mounted respectively to a carrier strip 12. Each terminal 10 generally includes an insulation displacement contact section at one end and a mateable contact portion at the opposed end adapted to mate with another electrical component. As shown in FIGS. 1 and 2, terminal 10 generally comprises a female pin-receiving contact portion 14 adapted to mate with a male pin portion (not shown) and a pair of substantially identical in-line generally parallel insulation displacement contacts 16 and 18. The insulation displacement contacts 16 and 18 are maintained in a spaced relationship of approximately 0.1 inch by connecting panel 19.

Figure 3:
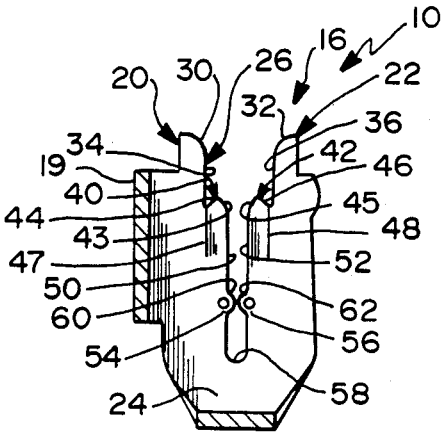
FIG. 3 is a cross-sectional view taken along line 3—3 in FIG. 1.
Figure 4:
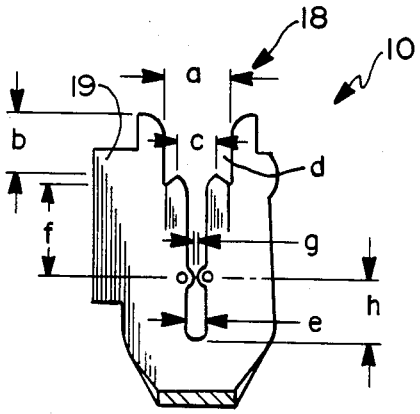
FIG. 4 is a cross-sectional view taken along line 4—4 in FIG. 1.
Figure 5:
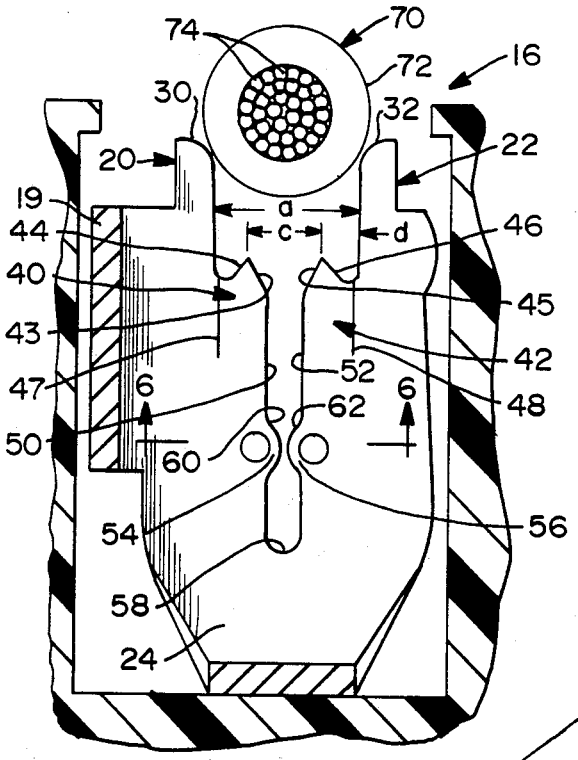
FIG. 5 is a cross-sectional view similar to FIG. 4 but showing a wire entering the terminal.

The insulation displacement contacts 16 and 18, as shown more clearly in FIGS. 3 and 4, and are intended for multi-strand wires having a large number of fine strands, and are further designed for high current applications and to achieve a desirably high pressure against the conductive strands of the wire. In particular, the insulation displacement contacts 16 and 18 are intended for high current applications, such as power cables, where the wires are typically provided with thicker insulation which must be pierced and displaced by the contacts 16 and 18.

The insulation displacement contact 16 comprises a pair of spaced apart substantially parallel cantilevered contact arms which are identified generally by the numerals 20 and 22, and which are joined at a common base 24. The spaced apart configuration of the cantilevered contact arms 20 and 22 defines a contact slot 26 therebetween. Furthermore, the cantilevered contact arms 20 and 22 are of generally stepped configuration to define varying widths at specific locations along the length of the slot 26 as described herein.

The free ends 30 and 32 of the cantilevered contact arms 20 and 22 respectively define inwardly facing convex arcuate surfaces which function to guide a wire with the insulation thereon into the slot 26. The cantilevered contact arms 20 and 22 further comprise generally straight parallel edges 34 and 36 which are spaced apart by a distance "a" approximately equal to or slightly less than the diameter of the wire with the insulation thereon. The arcuate surfaces 30, 32 and the parallel surfaces 34 and 36 effectively define an entry channel to the slot 26 which extends a longitudinal distance "b" approximately equal to the outer diameter of the wire employed with the contact 16.

The cantilevered contact arms 20 and 22 further comprise insulation piercing barbs 40 and 42 respectively which define sharp points for piercing through the insulation of the wire to be urged into the slot 26. More particularly, the point of the insulation piercing barb 40 is defined by an inwardly facing surface 43 which intersects an outwardly facing surface 44. Similarly, the point of the insulation piercing barb 42 is defined by an inwardly facing surface 45 which intersects an outwardly facing surface 46. The surfaces 43–46 of the insulation piercing barbs 40 and 42 are angularly aligned with respect to the axis of the slot. As will be explained in greater detail below, the inwardly facing angularly aligned surfaces 43 and 45 contribute to the guiding of the strands of conductor into proper position in the slot 26, while the angularly aligned outwardly facing surfaces 44 and 46 facilitate the use of a tool for securely entrapping the conductive strands of the wire in its fully seated position. The distance between the points of the insulation piercing barbs 40 and 42, as indicated by dimension "c" in FIG. 4 is approximately equal to or slightly greater than the diameter of the bundle of electrically conductive strands in the wire to be inserted in the contact 16. It follows that the distances "d" between the respective points of the insulation piercing barbs 40 and 42 and the associated parallel side walls 34 and 36 is approximately equal to or slightly less than the radial thickness of the insulation on the wire. The insulation piercing barbs 40 and 42 are further defined by longitudinally extending slits 47 and 48 which are generally collinear with the respective edges 34 and 36 of the cantilevered contact arms 20 and 22. The slits 47 and 48 extend a linear distance sufficient to enable the insulation piercing barbs 40 and 42 to be urged toward one another for entrapping the conductive strands of the wire in the slot as explained in greater detail below.

The cantilevered contact arms 20 and 22 include opposed parallel non-cutting conductor engaging surfaces 50 and 52 respectively. More particularly, the conductor engaging surfaces 50 and 52 are spaced apart a distance "e" which is substantially less than the diameter of the bundle of electrically conductive strands in the wire. The conductor engaging surfaces 50 and 52 extend from the angularly aligned inwardly facing surfaces 43 and 45 to the respective inwardly directed generally convex non-cutting bulges 54 and 56 on the cantilevered contact arms 20 and 22. The bulges 54 and 56 are in turn spaced from the bottom 58 of the slot 26. The length of the respective conductor engaging surfaces 50 and 52, as indicated by dimension "f" is selected in view of the width "e" to define a cross-sectional area for the conductor engaging portion of the slot which exceeds the cross-sectional area of the bundle of conductive strands to be engaged in the contact 16. Furthermore, the length "f" of the surfaces 50 and 52 preferably exceeds the length of the slits 47 and 48 in the respective cantilevered contact arms 20 and 22.

Figure 6:
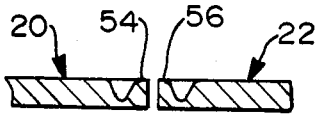
FIG. 6 is a cross-sectional view taken along line 6—6 in FIG. 5.
Figure 7:
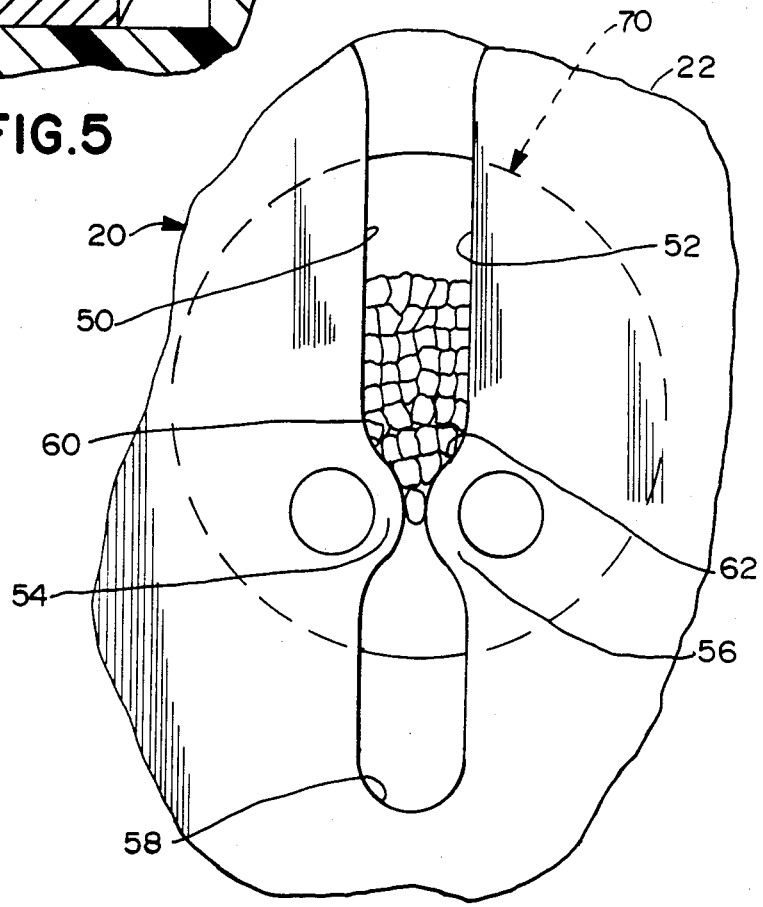
FIG. 7 is an enlarged cross-sectional view similar to FIG. 5 showing a wire fully mounted in the terminal.

The bulges 54 and 56 comprise inwardly converging non-cutting surfaces 60 and 62 which extend from the parallel conductor engaging surfaces 50 and 52. The converging configuration of the surfaces 60 and 62 create a ramped camming effect which converts the longitudinal insertion forces of the wire urged into the slot 26 into lateral forces on the cantilevered contact arms 20 and 22, as explained further below. The bulges 54 and 56 are dimensioned to significantly narrow the width of the slot 26. In particular, the distance "g" between the bulges 54 and 56 is preferably between 0.0–0.2 mm. Thus, the opposed bulges 54 and 56 may actually be in contact with one another or may be slightly spaced. The bulges 54 and 56 may be at least partly formed by the progressive die stamping of the entire insulation displacement terminal assemblies 10. However, with such stamping operations, it may be difficult to approach the 0.0 mm. spacing between the bulges 54 and 56. Therefore, in a preferred embodiment, the bulges 54 and 56 may be at least partly formed by a coining operation which stamps appropriate locations of the cantilevered contact arms 20 and 22 with a blunt, slightly rounded or slightly pointed instrument to deform local portions of the cantilevered contact arms 20 and 22, as shown in FIG. 6, to either create the bulges 54 and 56 or to urge the bulges 54 and 56 into closer proximity to one another.

As noted above, bulges 54 and 56 cooperatively form a restriction in the slot 26 to prevent downward movement of the wire strands as the wire is pushed into the slot 26 by termination tooling. The converging surfaces 60 and 62 of the bulges 54 and 56 effectively function as camming ramps which are operative to convert the longitudinal forces of the conductors urged into the slot 26 into lateral forces which urge the cantilevered contact arms 20 and 22 outwardly and away from one another. Thus, as explained further below, the bulges 54 and 56 enable the cantilevered contact arms 20 and 22 to develop and maintain a stored energy against the bundle of strands comprising the conductor.

The portion of the slot 26 disposed between the bulges 54 and 56 and the bottom 58 of the slot defines a width "e" substantially equal to the distance between the conductor engaging surfaces 50 and 52. Additionally, the bulges 54 and 56 are spaced from the bottom of the slot 58 by a longitudinal distance "h". The insulation displacement contact 16 preferably is designed to maximize the distance "h" between the bottom of the slot 58 and the bulges 54 and 56 to maximize the deflection of the cantilevered contact arms 20 and 22 to provide increased resilient contact forces against the conductor. Preferably, as shown in the Figures, the dimension "h" will be several times larger than the width of the slot as indicated by dimension "e". In designing the terminal, the dimensions "f" and "e" will be selected based upon the dimensions of the wire to be used with the terminal. However, the dimension "h" typically will be determined by the space available for the terminal, and will be maximized within the available space.

FIGS. 5–8 more clearly show how a multi-strand wire 70 is employed with the insulation displacement contact 16. In particular, the wire 70 is guided into the entry channel of slot 26 by the arcuate surfaces 30 and 32 and is then urged between the parallel entry channel surfaces 34 and 36 to begin the outward resilient deflection of the contact arms 20 and 22. A continued advancement of the wire 70 into the slot 26 will cause the insulation piercing barbs 40 and 42 to pierce through the insulation 72 and will urge the conductive strands 74 into the narrow portion of the slot 26 between the parallel non-cutting conductor engaging surfaces 50 and 52 thereof. As noted above, the fine strands 74 of the wire 70 will rearrange somewhat as they enter the portion of slot 26 between the parallel conductor engaging surfaces 50 and 52. However, a continued downward movement of the wire 70 into the slot 26 by a termination blade associated with termination tooling will urge the strands 74 into the ramped surfaces 60 and 62 of the bulges 54 and 56. The downward insertion force on the strands 74 on the ramped camming surfaces 60 and 62 will cause the cantilevered contact arms 20 and 22 to flex outwardly and away from one another, thereby developing and maintaining a stored energy in the form of inwardly directed forces by the resilient cantilevered contact arms 20 and 22 against the conductive strands 74. These forces on the conductive strands 74 in combination with the insertion forces provided by the insertion tooling are sufficient to create flats on the initially round conductive strands 74 as shown most clearly in FIG. 7. The inwardly directed forces by the cantilevered contact arms substantially reduces the tendency of the strands 74 to rearrange. Furthermore, the development of flats on the individual strands 74 by the stored energy of the cantilevered contact arms 20 and 22 effectively creates cross-sectional shapes of the strands that makes rearrangement of the strands less likely.

Figure 8:
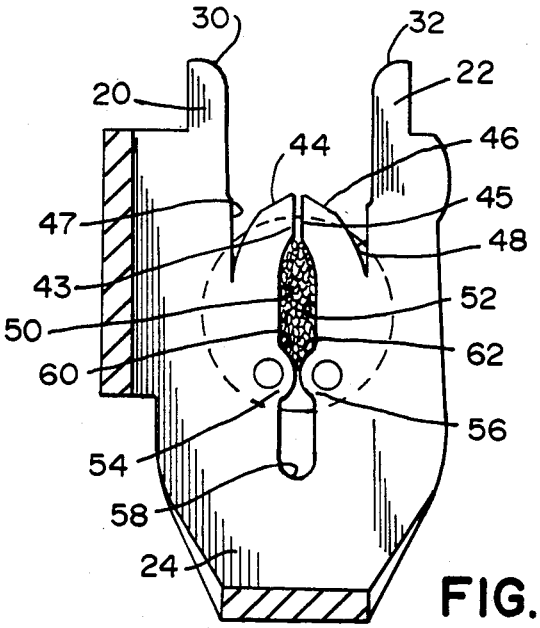
FIG. 8 is a cross-sectional view showing the barbs bent into engagement with the wire.

The bulges 54 and 56 of the cantilevered contact arms 20 and 22 substantially prevents the movement of the conductive strands 74 into the portion of the slot 26 between the bulges 54, 56 and the bottom 58. Any attempt to advance the conductive strands 74 further into the slot 26 will only increase the resilient lateral forces exerted by the cantilevered contact arms 20 and 22 and will make further movement of the wire 70 more difficult. These lateral forces exerted by the cantilevered contact arms 20 and 22 generally will be sufficient to retain the wire 70 in its proper position relative to the conductor engaging surfaces 50 and 52 and the bulges 54 and 56. However, in certain environments, such as high vibration environments, it may be further desirable to trap the wire 70 in its optimum position in the insulation displacement contact 16. This can be achieved by urging the insulation piercing barbs 40 and 42 toward one another as shown in FIG. 8. For example, a generally V-shaped tool having a maximum dimension approximately equal to or less than dimension "a" can be urged into the slot 26 such that the V-shaped portion of the tool engages the sloped surfaces 44 and 46 of the insulation piercing barbs 40 and 42. The camming action between the V-shaped tool and the insulation piercing barbs 40 and 42 will cause the insulation piercing barbs 40 and 42 to rotate away from the remainder of the cantilevered contact arms 20 and 22 at the longitudinal slits 47 and 48. Thus, as shown most clearly in FIG. 8, the conductive strands 74 will be positively retained within the slot 26 between the deformed insulation piercing barbs 40 and 42 and the bulges 54 and 56.

In summary, an insulation displacement terminal is provided with a pair of generally parallel cantilevered contact arms joined at a common base and with a slot defined therebetween. The surfaces of the cantilevered contact arms defining the slot are effectively stepped to define portions of varying width along the length of the slot. In particular, the entry to the slot is defined by arcuate surfaces to guide the wire into a channel of the slot having a width approximately equal to the diameter of the wire. Insulation piercing barbs are defined on the respective cantilevered contact arms at the base of the entry channel portion of the slot. The insulation piercing barbs terminate at points facing the entry channel, with the points being spaced apart a distance approximately equal to the diameter of the bundle of conductive strands in the wire. The insulation piercing barbs lead into a narrower strand engaging portion of the slot. The length and width of the strand engaging portion of the slot are selected to ensure that the entire bundle of conductive strands can be received therein. The cantilevered contact arms each comprise a bulge extending into the slot and defining the base of the strand engaging portion. The bulges may be dimensioned to be substantially in contact with one another and include ramped camming surfaces against which the strands of the wire will be urged. The bulges may be formed by a coining or by the initial stamping of the terminal. The distance between the bulges and the bottom of the slot is maximized to achieve a high bending moment and high inwardly directed stored energy against conductive strands urged into the slot. The insulation displacement barbs may be urged over a fully seated wire to retain the electrically conductive strands in their fully seated position.

While the invention has been described with respect to certain preferred embodiments, it is apparent that various changes can be made without departing from the scope of the invention as defined by the appended claims.

I claim:

1. An insulation displacement terminal for wires having multi-strand conductors, comprising: at least one insulation displacement contact including a pair of generally parallel spaced apart cantilevered contact arms connected to a common base and defining a slot therebetween, said cantilevered contact arms having opposed facing surfaces of generally stepped configuration to define an entry channel portion for said slot at the respective ends of said cantilevered contact arms most distant from said base, insulation piercing portions intermediate said entry channel portion and said base, a non-cutting conductor engaging portion intermediate said insulation piercing portion and said base, said conductor engaging portions of said slot having a width less than the width of said entry channel portion and having a length sufficient to retain a selected cross-sectional area of the conductors, said cantilevered contact arms comprising a pair of converging ramps intermediate said conductor engaging portion of said slot and said base such that said ramps are substantially adjacent said conductor engaging portion of said slot and spaced from said base, whereby a movement of the conductors parallel to said cantilevered contact arms and into said converging ramps biases said cantilevered contact arms away from one another and develops stored energy against said conductors.

2. An insulation displacement terminal as in claim 1 wherein the ramps define a minimum width for said slot of between approximately 0.0 and 0.2 mm.

3. An insulation displacement terminal as in claim 2 wherein said ramps define portions of bulges extending toward one another from the respective cantilevered contact arms.

4. An insulation displacement terminal as in claim 3 wherein the portion of said slot intermediate said ramps and said base of said terminal is wider than the minimum width portion of said slot defined by said ramps.

5. An insulation displacement terminal as in claim 1 wherein the ramps are formed by coining said cantilevered contact arms to displace portions of each said contact arm toward the other contact arm.

6. An insulation displacement terminal as in claim 5 wherein the distance between the ramps and the base of the terminal is greater than the width of the slot intermediate the ramps and the base.

7. An insulation displacement terminal as in claim 1 wherein the insulation displacement portion of each said cantilevered contact arm comprises an insulation displacement barb defined by at least two intersecting surfaces.

8. An insulation displacement terminal as in claim 7 wherein each said insulation displacement barb is partly separable from the associated cantilevered contact arm and is rotatable toward the insulation displacement barb of the other cantilevered contact arm.

9. An insulation displacement terminal for wires having multi-strand conductors, said terminal comprising: at least one insulation displacement contact including a pair of generally parallel spaced apart cantilevered contact arms unitarily connected to a base to define a slot therebetween, said cantilevered contact arms having opposed facing surfaces of generally stepped configuration such that each said cantilevered contact arm comprises an entry channel portion on the ends of said arm distal from said base, said entry channel portions being spaced apart a distance generally corresponding to the cross-sectional dimension of said wire; an insulation piercing barb disposed intermediate said entry channel portion and said base, each said insulation piercing barb generally facing away from the base; a conductor engaging portion generally adjacent said insulation piercing barbs and disposed intermediate said insulation piercing barb and said base, said conductor engaging portions of said arms being spaced apart a distance less than the cross-sectional dimension of said conductors; and a camming ramp intermediate said conductor engaging portion and said base and disposed substantially adjacent said conductor engaging portion, the camming ramps being disposed on the cantilevered contact arms to converge toward one another to define a constriction in said slot, whereby the insertion of a wire into the slot between said cantilevered contact arms urges the conductors thereof into contact with the camming ramps to bias said cantilevered contact arms away from one another and to develop stored energy for tightly retaining said conductors intermediate said conductor engaging portions of said slot.

10. An insulation displacement terminal as in claim 9 wherein the camming ramps define a minimum width constriction for said slot of between approximately 0.0 and 0.2 mm.

11. An insulation displacement terminal as in claim 9 wherein said camming ramps are in substantially abutting relationship prior to insertion of the wire into said terminal.

12. An insulation displacement terminal as in claim 9 wherein said ramps are defined by coined portions of said cantilevered contact arms.

13. An insulation displacement terminal as in claim 9 wherein said insulation piercing barbs are defined by pairs of cutting edges intersecting to define points directed generally away from said base.

14. An insulation displacement terminal as in claim 13 wherein each said insulation piercing barb is defined in part by a slit extending generally parallel to said arms such that said insulation piercing barbs are partly separable from the remainder of the respective cantilevered contact arms and can be rotated toward one another to engage the multi-strand conductor intermediate said camming ramps and insulation piercing barbs.

15. An insulation displacement terminal as in claim 9 wherein said camming ramps are spaced from said base by a distance substantially greater than the distance between said conductor engaging portions of said cantilevered contact arms.

* * * * *